US005581999A

United States Patent [19]

Johnson

[11] Patent Number: 5,581,999

[45] Date of Patent: Dec. 10, 1996

[54] BULKHEAD LINER WITH RAISED LIP

[75] Inventor: Thomas E. Johnson, Manchester, Conn.

[73] Assignee: United Technologies Corporation, Hartford, Conn.

[21] Appl. No.: 356,088

[22] Filed: Dec. 15, 1994

[51] Int. Cl.[6] ..... F02C 3/06

[52] U.S. Cl. ..... 60/39.36; 60/39.31; 60/756

[58] Field of Search ..... 60/39.31, 39.32, 60/39.36, 740, 748, 752, 756, 757

[56] References Cited

U.S. PATENT DOCUMENTS 5,353,599 10/1994 Johnson et al. ..... 60/748

*Primary Examiner*—Timothy Thorpe

*Assistant Examiner*—Teo Kim

*Attorney, Agent, or Firm*—Edward L. Kochey, Jr.

[57] ABSTRACT

Bulkhead 14 is conical and therefore the surface of bulkhead liners 30 has a curved or arcuate surface 68. Raised lip 70 with planar surface 72 is adjacent and surrounded in each opening 20. Fuel nozzle guide 24 may be rotated against and sealed to the surface of the liner segments.

4 Claims, 3 Drawing Sheets

BULKHEAD LINER WITH RAISED LIP

TECHNICAL FIELD

The invention relates to bulkhead liners for combustors of gas turbine engines and in particular to a lip on liners which have a conical shape.

BACKGROUND OF THE INVENTION

Fuel nozzles are located on the upstream end of gas turbine engine combustor. A fuel nozzle guide is required to maintain the position of the fuel nozzles with respect to the bulkhead and bulkhead liner at the upstream end of the combustor.

With an annular combustor having the bulkhead wall tilted with respect to the gas turbine axis the bulkhead forms a conical surface. The bulkhead liner has a similar shape.

Fuel nozzle guides are usually rotated to engage a fuel nozzle guide retainer. These are screwed in from the combustor side of the bulkhead liner. A plane surface for interaction between the liner and the fuel nozzle guide facilitates the assembly by permitting rotation of the guide and tightening to any position, with the ability to stop and lock at any point in the rotation. The plane surface of the two mating parts also permits sliding movement in all directions in this plane of contact.

Copending application Ser. No. 08/356,093 describes an assembly for retaining fuel nozzle guides.

SUMMARY OF THE INVENTION

The end of the gas turbine engine combustor has a frustoconical bulkhead forming the upstream end of the combustor. The bulkhead liner is preferably formed by a plurality of sections or segments lining the combustor side of the bulkhead. Each liner section, as well as the bulkhead has an opening for the insertion of a fuel nozzle. Adjacent this opening the liner segment inherently has an arcuate shape face facing the combustor because of the frustoconical shape. Each segment according to the invention has a raised planar surface adjacent the opening whereby the fuel nozzle guide may be rotated while abutting the raised planar surface.

DESCRIPTION OF THE PREFERRED EMBODIMENT

Figure 1:
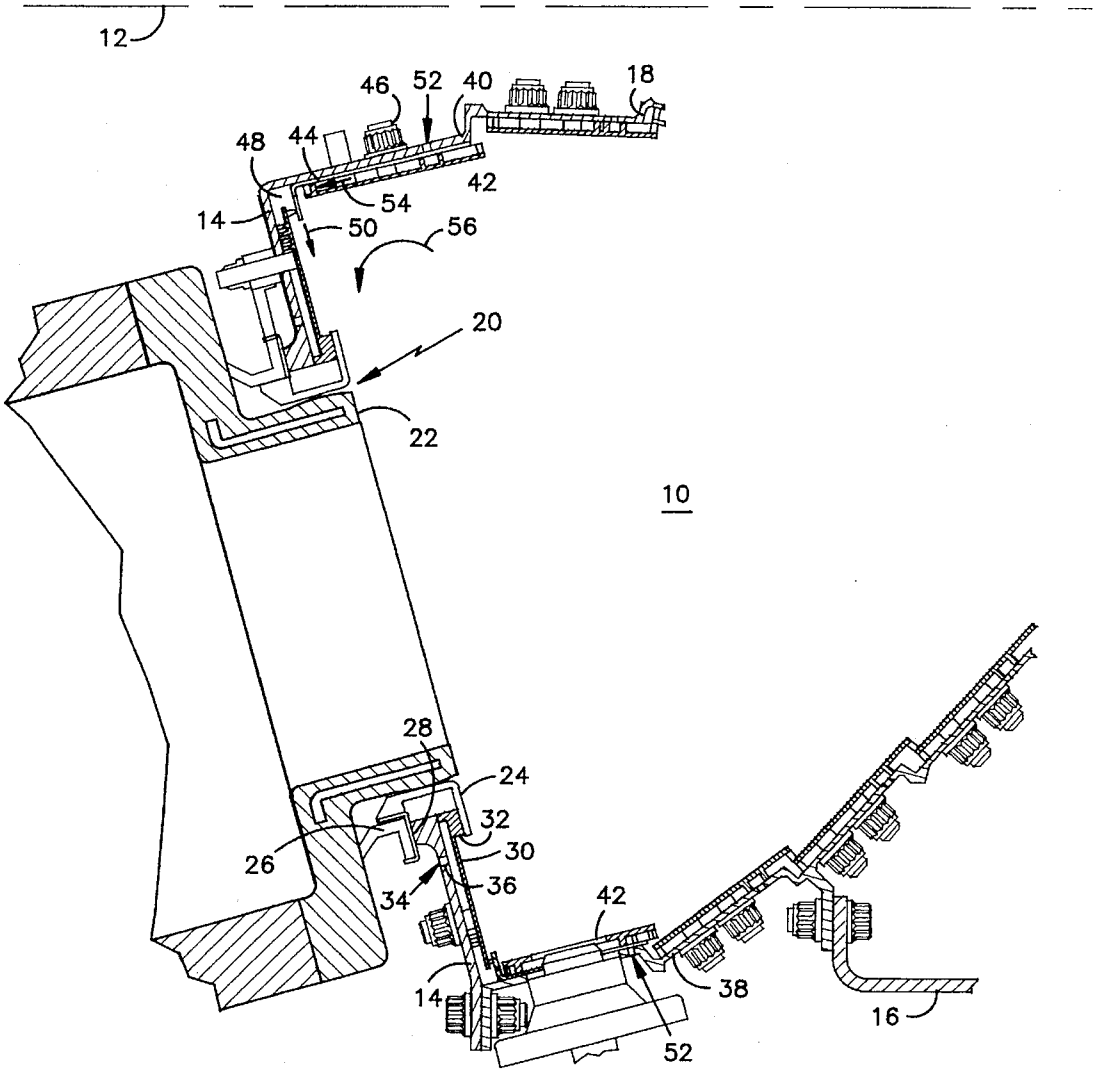
FIG. 1 is a sectional view of a combustor gas turbine engine.

FIG. 1 shows an annular gas turbine combustor 10 and the centerline 12 of the gas turbine engine. The conical bulkhead 14 is supported from support structures 16 and 18. Sixteen gas turbine nozzle openings 20 are located around the circumference of the bulkhead.

A plurality of fuel nozzles 22 are locatable within these openings. These nozzles are preferably of the low $NO_x$ type with premixing of fuel and air for low temperature combustion. At each opening there is a fuel nozzle guide 24 which is axially restrained with fuel nozzle guide retainer 26. The key washer 28 prevents rotation of the fuel nozzle guide retainer 26 after installation.

The fuel nozzle guide 24 and the retainer 26 are secured to contain between them the key washer 28, the bulkhead 14 and the bulkhead liner 30. Good contact at 32 is maintained between the guide and the liner segments to avoid any significant amount of air passing therethrough. Similarly good contact is maintained on both sides of the key washer 28 to prevent significant air flow past the washer.

The cooling air flow 34 passes through a plurality of openings 36 in the bulkhead impinging against the bulkhead liner 30, with the air passing behind the liner in a direction away from the location of fuel nozzle 22.

An outer shell 38 and an inner shell 40 define the boundaries of the combustor and have bolted thereto a plurality of float wall liner panels 42 at the upstream end of the combustor. A fairing 44 is entrapped between the adjacent shell and the liner panel 42. A plurality of studs and bolts 46 removably secure this structure.

The cooling air flow passing toward the shells and between the bulkhead and the bulkhead liner flows toward the corner area 48 where it turns and is guided in direction 50 along the bulkhead liner.

Cooling flow 52 passing through the inner shell and the outer shell impinges against the liner 42 with the portion of this flow passing as flow 54 toward corner 48 where fairing 44 also deflects it toward the fuel nozzle. The recirculating type flow 56 desired within the combustor is not disturbed by the direction of flow 50 which cools the bulkhead liner.

Figure 2:
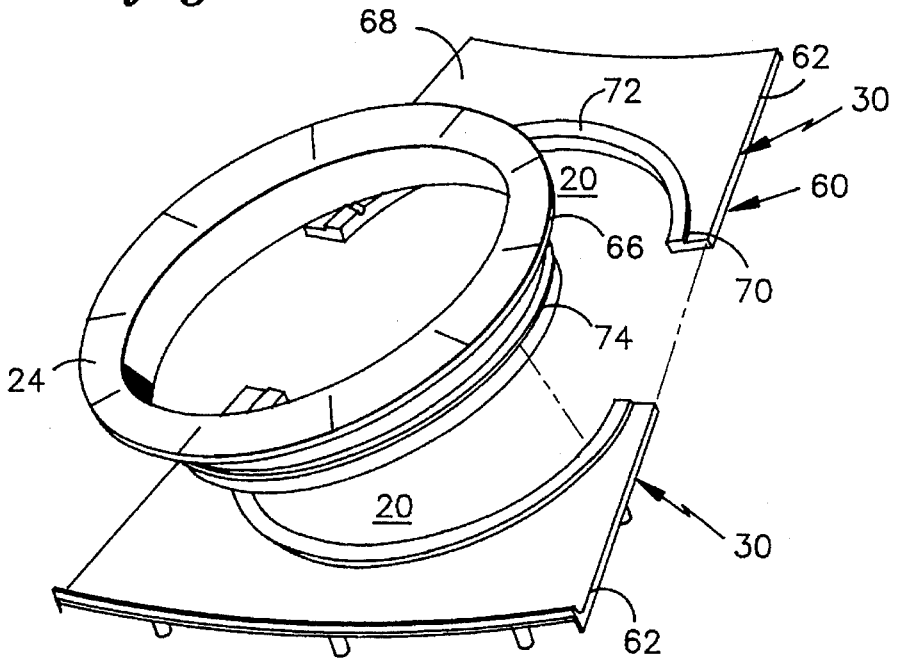
FIG. 2 is an exploded view of the nozzle guide and the segmented bulkhead liner.

Referring to FIG. 2 the bulkhead liner 30 has a plurality of sections 60, each divided into two segments 62. Opening 20 is located in the midst of each section for the reception of the fuel nozzle guide 24. An outstanding flange 66 on the fuel nozzle guide extends radially outwardly and has a planar surface on the side abutting the liner 60. Surface 68 of the bulkhead liner 30 is curved because of the conical surface being covered.

A raised lip 70 with planar surface 72 facing the combustor is located adjacent the opening. This surface is imperforate and interacts with surface under flange 66 as the fuel nozzle guide is rotated on threads 74 for mating with the fuel nozzle guide retainer (not shown). An air seal is thereby effected between the liner and the fuel nozzle guide. This is effective where inside to outside cooling is not desired, this being cooling of the bulkhead liner with flow from the nozzle area toward the shell.

Figure 3:
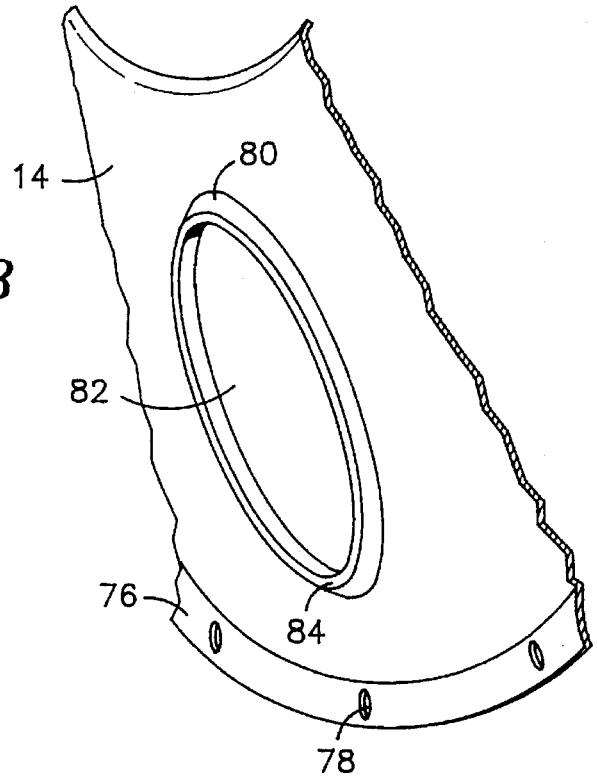
FIG. 3 is a fragmentary view of the bulkhead.

FIG. 3 shows a fragmentary portion of the bulkhead 14 with bent flange 76 at the outer edge having bolt holes 78 for bolting to the shell 38, which is shown in FIG. 1. This bulkhead may also have a raised lip 80 surrounding opening 82 on the upstream side of the bulkhead. This provides the planar surface 84 for interaction with a fuel nozzle guide retainer such as 26 of FIG. 1. While this retainer is not rotated during installation, the planar surface supplied here for engagement therewith facilitates and simplifies the manufacturer of the retainer.

Figure 4:
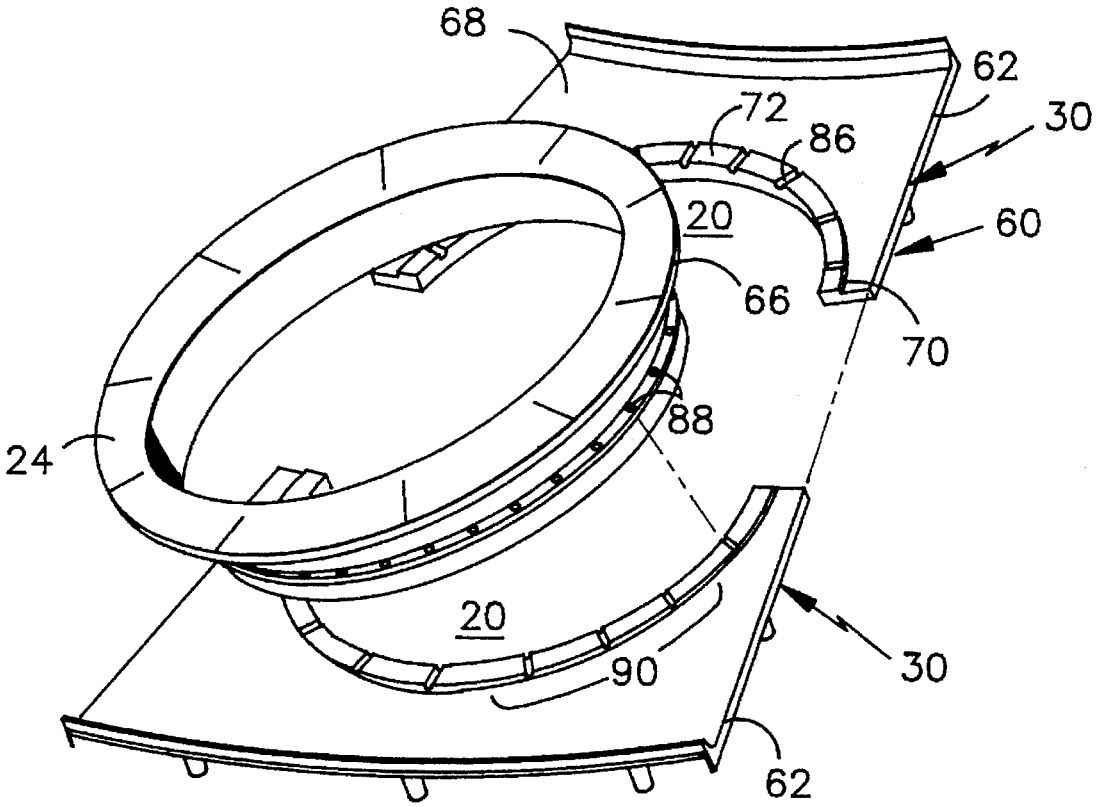
FIG. 4 is an exploded view of an alternate design.

FIG. 4 is a view similar to FIG. 2, but for a combustor where inside to outside cooling airflow across the liner is desired. Slots 86 through the raised planar surface and holes 88 in the fuel nozzle guide permit a flow of cooling air. This flow is directed across the surface of the bulkhead liner segments.

These openings are not equally spaced and/or sized. More opening flow area is preferred in zone 90, where there is more exposed area to be cooled.

Accordingly there is achieved a good fit between the nozzle guide and the mating surface of the bulkhead liner which is free to move in all directions along the plane defining the interaction and which permits rotation of the fuel nozzle guide to any position during assembly.

I claim:

1. A bulkhead liner for an annular gas turbine engine combustor having a frustoconical bulkhead forming the upstream end of said combustor comprising:

a plurality of bulkhead liner segments lining the combustor side of said bulkhead;

each segment having an opening for the insertion of a fuel nozzle;

each segment being tilted with respect to a longitudinal centerline of the gas turbine engine to form a portion of a cone having a conical arcuate surface facing the combustor; and each segment having a raised planar surface adjacent said opening, said raised planar surface being non-parallel to said conical arcuate surface and having a variable height with respect to the conical arcuate surface, the combustor further having a fuel nozzle guide fitting within said opening where said guide has a radially extending flange, such that a flange of said fuel nozzle guide located within said opening may be rotated while abutting said raised planar surface.

2. A bulkhead liner as in claim 1, wherein:

each segment has an edge adjacent said opening; and the opening in each segment is located at said edge of said segment, and said raised planar surface is substantially a semicircle.

3. A bulkhead liner as in claim 1, wherein:

said raised planar surface is imperforate and abuts said fuel nozzle guide flange, whereby an air seal is effected.

4. A bulkhead liner as in claim 1, further comprising:

a plurality of slots through said raised planar surface, whereby a flow of air is permitted through said slots and along the surface of said bulkhead liner.

* * * * *